US009617193B2

(12) United States Patent
Schroder et al.

(10) Patent No.: US 9,617,193 B2
(45) Date of Patent: Apr. 11, 2017

(54) METHOD FOR MANUFACTURING ENERGETIC MATERIAL COMPOSITES

(75) Inventors: Kurt A. Schroder, Coupland, TX (US); Ronald Ian Dass, Austin, TX (US)

(73) Assignee: NCC NANO, LLC, Dallas, TX (US)

( * ) Notice: Subject to any disclaimer, the term of this patent is extended or adjusted under 35 U.S.C. 154(b) by 971 days.

(21) Appl. No.: 13/035,450

(22) Filed: Feb. 25, 2011

(65) Prior Publication Data

US 2012/0216926 A1 Aug. 30, 2012

(51) Int. Cl.
*C06B 33/00* (2006.01)

(52) U.S. Cl.
CPC ..... *C06B 33/00* (2013.01)

(58) Field of Classification Search
CPC ..... C06B 23/00; C06B 23/04; C06B 29/02
See application file for complete search history.

(56) References Cited

U.S. PATENT DOCUMENTS 5,656,793 A * 8/1997 Ochi et al. ..... 149/22

* cited by examiner

*Primary Examiner* — Aileen B Felton
(74) *Attorney, Agent, or Firm* — Russell Ng PLLC; Antony P. Ng

(57) ABSTRACT

An energetic material composite comprising fuel particles and a hydrated compound is disclosed. The energetic material composite is formed by dispersing fuel particles, which have a negative standard reduction potential relative to a standard hydrogen electrode, in a solvent containing dissolved hydrate, followed by a removal of solvent. When initiated, the fuel particles react with the water bound in the hydrated compound to release energy and hydrogen gas.

8 Claims, 1 Drawing Sheet

METHOD FOR MANUFACTURING ENERGETIC MATERIAL COMPOSITES

BACKGROUND OF THE INVENTION

1. Technical Field

The present invention relates to energetic materials in general, and, in particular, to a method for manufacturing energetic material composites.

2. Description of Related Art

Theoretically, aluminum and water react exothermically to form aluminum oxide and hydrogen gas:

$$2Al_{(s)}+3H_2O_{(l)}\rightarrow Al_2O_{3(s)}+3H_{2(g)}\Delta H=-818\text{ kJ}$$

It is a very energetic chemical reaction capable of generating 7.6 kJ of energy per gram of reactants (i.e., aluminum and water). The combination of hydrogen's relatively low molecular weight and the high energy generated from the chemical reaction allows hydrogen gas to be released at a very high average speed during chemical reactions. This property makes the above-mentioned reaction pair desirable as a propellant formulation.

In practice, however, aluminum and water are rarely used together as an energetic material. This is because the energy release rate of the chemical reaction between aluminum and water is very slow unless aluminum is in the form of very fine particles. For example, it is quite difficult to ignite aluminum powder of approximately 5 microns in diameter (which are considered as fine particles) mixed stoichiometrically with water because the mixture often self-extinguishes due to low reaction rate.

When very fine aluminum particles are used, the reaction rate increases to the point of mimicking a very fast burning propellant. The size of very fine aluminum particles is usually below 200 nm in diameter (i.e., 11 $m^2/g$ if the particles are spherical). This type of very fine aluminum particles is commonly referred to as nanoaluminum powder or nanoaluminum. The problem with nanoaluminum is that it is unstable in water even at room temperature. At 25° C., 80 nm diameter (i.e., 28 $m^2/g$) nanoaluminum particles in deionized water will begin to react with the water, such as generating hydrogen gas bubbles, within a few minutes of mixing.

SUMMARY OF THE INVENTION

Consequently, it would be desirable to provide an improved method for making an energetic material. In accordance with a preferred embodiment of the present invention, a hydrate is initially dissolved in a solvent to form a solution. Fuel particles are then dispersed in the solution. The solvent is subsequently removed and an energetic material composite is left behind.

Alternatively, fuel particles are initially dispersed in a solvent. A hydrate is then dissolved in the dispersion to form a solution. The solvent is subsequently removed from the solution and an energetic material composite is left behind.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 3:
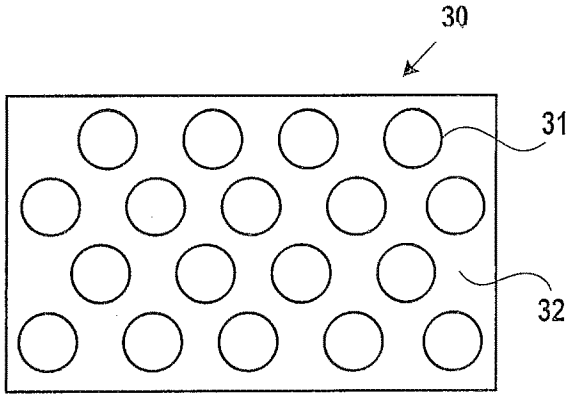
FIG. 3 illustrates a cross-sectional view of an energetic material composite generated by methods shown in FIG. 1 or 2.

Hydrates, which are chemical compounds that contain chemically-bound water, are typically in solid form at room temperature. Hydrates may include, for example, metal oxides, sulphates, sulphides, nitrates, selenates, chlorates, etc. A representative set of hydrates is listed in Table I. Some of the hydrates have stored volumetric water densities approaching that of pure water (i.e., 1.0 $g/cm^3$). In effect, hydrates are vehicles for storing solid water at room temperature at a density approaching that of pure water.

TABLE I

| Hydrate | Mass % $H_2O$ | Density [$g/cm^3$] | $H_2O$ density [$g/cm^3$] |
|---|---|---|---|
| $Al_2O_3 \cdot 3H_2O$ | 34 | 2.40 | 0.82 |
| $MgO \cdot H_2O$ | 31 | 2.40 | 0.74 |
| $Na_2B_4O_7 \cdot 10H_2O$ | 47 | 1.73 | 0.81 |
| $Al_2(SO_4)_3 \cdot 16H_2O$ | 46 | 1.69 | 0.81 |
| $MgSO_4 \cdot 7H_2O$ | 51 | 1.67 | 0.85 |
| $ZnSO_4 \cdot 7H_2O$ | 44 | 2.07 | 0.91 |
| $Na_2SO_4 \cdot 10H_2O$ | 56 | 1.46 | 0.82 |
| $Fe(NO_3)_3 \cdot 9H_2O$ | 40 | 1.68 | 0.67 |
| $Na_2S \cdot 9H_2O$ | 68 | 1.43 | 0.97 |
| $HBO_2 \cdot H_2O$ | 29 | 1.44 | 0.42 |
| $2ZnO \cdot 3B_2O_3 \cdot 3.5H_2O$ | 14 | 2.80 | 0.39 |
| $CoCl_2 \cdot 6H_2O$ | 45 | 1.92 | 0.86 |
| $KCr(SO_4)_2 \cdot 12H_2O$ | 43 | 1.83 | 0.79 |
| $KAl(SeO_4)_2 \cdot 12H_2O$ | 38 | 2.00 | 0.76 |

Most hydrates release water to become their anhydrous form at a temperature above the boiling point of water (100° C.), indicating that there is a small amount of binding energy. Others hydrates melt at a temperature below the boiling point of water, effectively releasing their energy for reaction well above the freezing point of water. In both cases, water is essentially stored in hydrates in its solid form far above the freezing point of water (0° C.).

Generally speaking, when a hydrate is mixed with an organic fuel, the mixture is not energetic. In fact, hydrates are commonly used as fire retardants because the release of water by the hydrates is endothettnic and is capable of cooling fire. Similarly, hydrates are also used in organic pyrotechnic compounds in smaller amounts for reducing the burn rate of organic pyrotechnic compounds. An example of a hydrated fuel used for burn rate suppression is dextrose monohydrate ($C_6H_{12}O_6.H_2O$).

When water is mixed with a fuel having a negative standard reduction potential relative to a standard hydrogen electrode, such as aluminum, magnesium, titanium, boron, silicon etc., there is potential for the water to react with the fuel. In order to make a composition that reacts quickly enough to be of interest, the particles need to be very fine. Usually the particles need to be below 200 nm in diameter, or have a specific surface area of greater than about 11 $m^2/g$ if they are made of aluminum. When aluminum of this size (often referred to as nanoaluminum) is mixed with water at room temperature, the composition has a shelf life of less than a day.

An example of a stable aluminum/water composition that reacts quickly is the aluminum-ice propellant formulation known as ALICE propellant. This formulation is comprised of nanoaluminum mixed with water. Shortly after mixing, the composite is frozen to prevent the nanoaluminum from reacting with the water. The same benefits can be realized by using the water trapped within hydrates via solution processing. The usage of hydrates eliminates the need of freezing a composition. It also increases the reaction rate, and, in some cases, increases the volumetric energy density of the composition.

Figure 1:
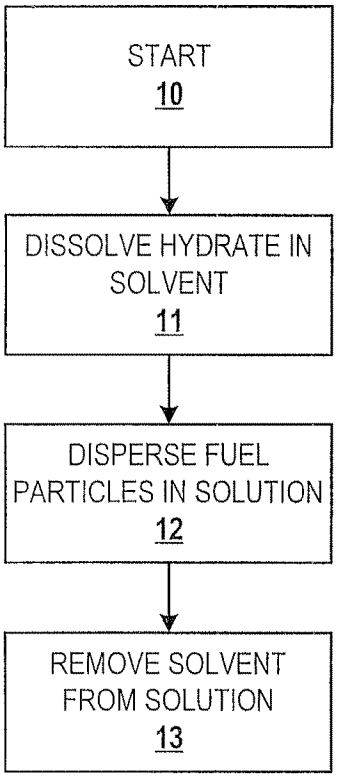
FIG. 1 depicts a method for forming an energetic material composite, in accordance with a preferred embodiment of the present invention.

Referring now to the drawings and in particular to FIG. 1, there is depicted a method for forming an energetic material composite using hydrates, in accordance with a preferred embodiment of the present invention. Starting with block 10, a hydrate is dissolved in a solvent to form a solution, as shown in block 11. The solvent is preferably water. Then, fuel particles are dispersed in the solution, as depicted in block 12. The fuel is comprised of particles having a negative standard reduction potential relative to a standard hydrogen electrode, such as aluminum, magnesium, titanium, boron, silicon, etc. The solvent is subsequently removed from the solution, for example, via evaporation to form an energetic material composite, as shown in block 13. Other methods of removing solvent from the solution include heating, vacuum drying, freeze drying, etc. This solution technique mixes the hydrate with the fuel on a nanometer scale and thus increases the reaction rate when initiated over other mixing techniques.

Figure 2:
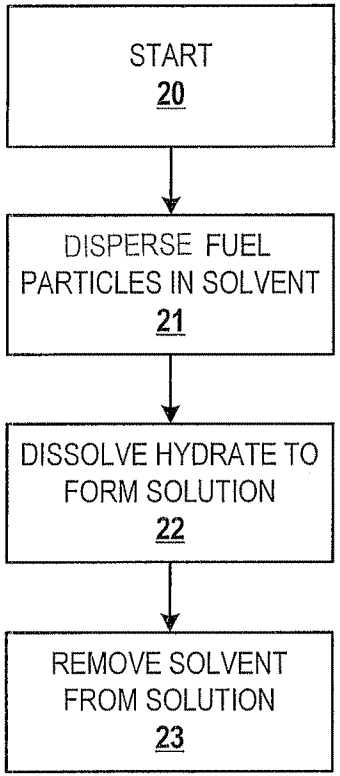
FIG. 2 depicts a method for forming an energetic material composite, in accordance with an alternative embodiment of the present invention.

Steps shown in blocks 11 and 12 of FIG. 1 can be reversed. With reference now to FIG. 2, there is depicted a method for forming an energetic material composite using hydrates, in accordance with an alternative embodiment of the present invention. Starting with block 20, fuel particles are initially dispersed in a solvent, as shown in block 21. Then, a hydrate is dissolved in the dispersion to form a solution, as depicted in block 22. The solvent is subsequently removed from the solution to form an energetic material composite, as shown in block 23.

The energetic material composite of the present invention is similar to the above-mentioned water-fuel composite but with the following three advantages. The first advantage is that hydrates are typically solid at room temperature, which allows fine fuel particles to be incorporated within them without spontaneously reacting far above the freezing point of water. Thus, no special environment is needed for maintaining the long-term stability of the energetic material composite. The second advantage is that the reaction rate of energetic material composites is often faster than a simple mixture of fuel particles and water. The third advantage is that the volumetric energy density of energetic material composites can be significantly higher than a simple mixture of fuel particles and water.

In general, when very fine fuel particles are thoroughly mixed with very fine hydrates (i.e., both are less than 2 micron in diameter or having a specific surface area of greater than 1 $m^2/g$), the propagation speed can be increased. In the present invention, a hydrate is dissolved in a solution and fuel particles are dispersed in it followed by removal of the solvent. When this is done, the hydrate can be mixed on a nanometer scale with the fuel particles. This intimate mixing can increase the propagation speed of the energetic material composite by orders of magnitude when initiated—effectively transforming it from a material that burns like a sparkler to one that can mimic an explosive.

Similar to the ALICE propellant, the energetic material composite of the present invention is stable, presumably due to the fact that in both cases, a phase change is needed to release water for reacting with aluminum. The difference between energetic material composites and ALICE propellant is that, in the former, the temperature at which the phase change occurs is much higher, and, in some cases, more gradual. The implication is that an energetic material composite must be heated to a higher temperature before it can be initiated. The higher temperature of initiation makes an energetic material composite more insensitive to initiation, but after it has been initiated, the propagation speed is faster because both the oxidizer and fuel have already been preheated. In addition to increasing the burn speed, this effect also allows one to use larger (and often cheaper) fuel particles and still achieve a relatively fast propagation speed. With the method of the present invention, burn rates of interest can be achieved by using 2 micron diameter aluminum particles (specific surface area=1 $m^2/g$), whereas the same particles mixed with water will not even propagate.

Since the oxidizer in energetic material composites is ordinarily used as a fire retardant, a low-temperature heat source will generally release the bound water resulting in a cooling of the mixture. Eventually, all of the water evaporates, which renders the composite non-energetic, such as when $Al_2O_3.3H_2O$ is used as the oxidizer, or a less energetic material, such as when $ZnSO_4.7H_2O$ is used. When initiated with a high-temperature heat source, the latter's reaction with aluminum can be illustrated by the following reaction equation:

$$3ZnSO_4.7H_2O_{(s)}+22Al_{(s)}\rightarrow 11Al_2O_{3(s)}+3Zn_{(s)}+3S_{(s)}+21H_{2(g)}\Delta H=-9{,}199\ kJ$$

This reaction corresponds to an energy generation of 14.4 $kJ/cm^3$, which is nearly 40% higher than that of an aluminum/water composite, and even approaches the energy density of some high-energy thermite reactions. It releases 83% of the energy released by the aluminum/water reaction per gram. However, only 62% of the total energy released comes from the aluminum/water component. This is due to the fact that some of the aluminum is reacting with the oxygen in the sulphate anion. For the same reason, the hydrogen generation is less than the aluminum/water reaction. Table II details the energy release of this particular composite versus other materials.

TABLE II

| | Al/Zinc sulphate heptahydrate | Al/ water | TNT | Al/CuO Thermite |
|---|---|---|---|---|
| Energy density [kJ/g] | 6.3 | 7.6 | 4.7 | 4.1 |
| Energy density [$kJ/cm^3$] | 14.4 | 10.4 | 7.8 | 20.8 |
| g of $H_2$ generated/ g of reactants | 0.029 | 0.056 | n/a | n/a |
| g of $H_2$ generated/ $cm^3$ of reactants | 0.066 | 0.077 | n/a | n/a |

Although some of these composites can be initiated with a match, others need a hot wire or a MAP gas torch in order to reliably initiate them.

Since water is bound in hydrates by a small amount of energy, it is prevented from spontaneously reacting with the aluminum. In contrast to other nanoaluminum-based energetic materials, the metastable intermolecular composites, these composites are comparatively insensitive.

The burn rate of the energetic material composites of the present invention can be controlled by adjusting particle size or the mix of particle size. For example, a mix containing 90% of 2 micron spherical particles (specific surface area approximately 1 $m^2/g$), and 10% of 65 nm aluminum burns much faster than 100% of 2 micron particles. The burn rate of the energetic material composites of the present invention can also be controlled by choosing the amount and type of hydrates mixed with the fuel particles.

Some hydrates, such as Glauber's salt ($Na_2SO_4.10H_2O$), can be melted (at 32° C.). This allows the fuel powder to be mixed in directly without the need for a solvent. When nanoaluminum is mixed in at room temperature (25° C.), it begins to release hydrogen within a few minutes, making it impractical without some pH buffering of the solution or coating of the particles.

In order to stave off hydrogen production during extended processing with fine aluminum particles, a pH buffer can be added to the hydrate or to the solution to retard reaction of the aluminum with the water. This can be accomplished with a standard pH 7.00 buffer (manufactured by Ricca Chemical Company in Arlington, Tex.). This buffer has dibasic sodium phosphate and monobasic potassium phosphate in water. 40 nm nanoaluminum can be dispersed in this buffer, which prevents the nanoaluminum from reacting with the water in the buffer at room temperature (25° C.) for up to five years. Alternatively, the pH of the solution can be controlled by selecting an alkaline hydrate such as $MgSO_4.7H_2O$ and an acidic hydrate such as $ZnSO_4.7H_2O$, and adjusting their ratio until the desired pH level is attained. These practices become less critical when the size of fuel particles is larger.

When the hydrate is not easily dissolved or melted, it can be dispersed along with the fuel powder in a solution containing a dissolved inorganic oxidizer such as ammonium perchlorate, potassium nitrate, etc. After the removal of solvent, the inorganic oxidizer is mixed with the fuel particles on a nanoscale, allowing the hydrate to participate in the reaction with the fuel particles.

When different hydrate/metal particle pairs are mixed in the same formulation, the burn rate characteristics of the final mixture can be tailored to a particular application. An example is substituting a hydrate for some of the water in the ALICE rocket propellant formulation. Substituting $MgSO_4.7H_2O$ or $ZnSO_4.7H_2O$ for some of water can increase the burn rate of ALICE rocket propellant. They also have the benefit of being a dispersing aid since the viscosity of the mix with some sulphates decreases from a clay-like consistency (~1,000,000 cps) to that of peanut butter like consistency (~100,000 cps). This will allow better mixing and more consistent burning or/and allow the incorporation of other materials into the formulation.

EXAMPLE 1

Fast Reaction Rate Material

Dissolve 10.0 g of $ZnSO_4.7H_2O$ in 10.0 g of water at 25° C.

Add 1.33 g of 65 nm oxide-passivated nanoaluminum (75% wt. metal content) (manufactured by NovaCentrix in Austin, Tex.) to 4.5 g of the above solution.

Stir dispersion for 30 seconds with a wooden rod.

Place 5.0 g of the dispersion in an oven at 105° C. for 10 minutes to remove water.

Resulting energetic material composite may be initiated with a match.

EXAMPLE 2

High Reaction Rate/High Volumetric Energy Density Material

Dissolve 13.0 g $MgSO_4.7H_2O$ in 20 g water.

Add 1.33 g of 65 nm oxide-passivated nanoaluminum (75% wt. metal content) (manufactured by NovaCentrix in Austin, Tex.) to 5.0 g of the above solution.

Stir dispersion for 30 seconds with a wooden rod.

Place 5.0 g of the dispersion in an oven at 105° C. for 10 minutes to remove water.

EXAMPLE 3

High Volumetric Energy Density Material

Same procedure as Example 2, but substitute 1.0 g of 2 micron aluminum powder (manufactured by Valimet in Stockton, Calif.) per 1.33 g of nanoaluminum.

EXAMPLE 4

High Energy Density Material

Melt 16.7 g of $Na_2SO_4.10H_2O$ at a temperature above 32° C.

Mix in 10.0 g of 2 micron diameter aluminum powder (manufactured by Valimet in Stockton, Calif.) to the melt.

Stir mixture for 30 seconds with wooden rod.

Allow mixture to cool below 32° C. to form a solid energetic material composite.

Resulting material may be initiated with a MAP gas torch.

EXAMPLE 5

Energetic Material with Insoluble Hydrate

Dissolve 0.4 g $NH_4ClO_4$ in 10 g water.

Mix in 2.9 g $Al_2O_3.3H_2O$.

Mix in 2.0 g of 2 micron diameter aluminum powder (manufactured by Valimet in Stockton, Calif.).

Stir dispersion for 30 seconds with a wooden rod.

Place 5.0 g of dispersion in an oven at 105° C. for 10 minutes to remove water.

Resulting material can be initiated with hot wire, MAP gas torch, or thermite.

EXAMPLE 6

Substituting Hydrate for Water in ALICE Propellant

Dissolve 5.0 g of $MgSO_4.7H_2O$ into 10 g water.

Add 2.66 g of 65 nm oxide-passivated nanoaluminum (75% wt. metal content) (manufactured by NovaCentrix in Austin, Tex.) to 2.4 g of above solution.

Stir with wooden rod for 30 seconds.

Sonicate dispersion in bath for 5 minutes.

Place dispersion in freezer at −18° C. to form stable energetic material composite.

Resulting material can be initiated with hot wire, MAP gas torch, or thermite.

Unlike the other examples, no water needs to be removed in the final step as it participates in the chemical reaction.

EXAMPLE 7

Multiple Hydrate Composition

Dissolve 1.0 g of $ZnSO_4.7H_2O$ and 1.0 g of $MgSO_4.7H_2O$ in 5 g of water at 25° C.

Add 1.26 g of 65 nm oxide-passivated nanoaluminum (75% wt. metal content) (manufactured by NovaCentrix in Austin, Tex.) to the above solution.

Stir dispersion for 30 seconds with a wooden rod.

Place dispersion in an oven at 105° C. for 10 minutes to remove water.

Resulting material may be initiated with a match.

Referring now to FIG. 3, there is illustrated a cross-sectional view of an energetic material composite, in accordance with a preferred embodiment of the present invention. As shown, an energetic material 30 includes multiple fuel particles 31 interspersed within a solid hydrate 32. Applications of energetic material 30 include:

i. Gun propellants. Since energetic materials are very fast burning, have a high energy density, and the hydrogen gas generated is low in molecular weight, the use of the energetic material composites as propellants for guns has the ability to increase the projectile velocity. This is particularly valid for cases in which high projectile velocity is desired and one approaches the sonic limit for traditional propellants.

ii. Rocket propellants. Since the energy release from energetic materials is large and the hydrogen gas generated is low in molecular weight, they are good candidates for rocket propellants. Although the energy density per mass of propellant is less than that of an ALICE propellant formulation, the burn rate is faster, and the volumetric energy density is higher. Hydrate may be substituted for some or all of the water in the ALICE propellant formulation to boost performance.

iii. Fuel cells. Energetic materials generate hydrogen upon reacting and are good candidates for generating hydrogen in fuel cells. Energetic materials generate hydrogen above room temperature. The hydrogen production can be turned on and off by raising or lowering the temperature of the mixture, e.g., with $Al/Na_2SO_4.10H_2O$, so that the water in the hydrate is in a solid form again.

iv. Initiation of secondary explosives. The reaction rate of some energetic materials, such as nanoaluminum/zinc sulphate heptahydrate, is very fast and may be able to mimic the effects of certain types of explosives. When nanoaluminum is used as the fuel particles, these compositions are classified as nanoscale energetic composites. However, they differ from the more familiar nanoscale energetic composites called nanothermites or superthermites, which are chemically similar to traditional thermites, but they are comprised of nanoaluminum and a nanoscale metal oxide instead of micron sized powders. Nanothermites can be used as primers for initiation of propellants, but generally are not used to initiate secondary explosives since they do not have adequate gas generation to generate a strong shock. In contrast, the nanoscale composites of the present invention generate a comparatively large amount of gas. Furthermore, since the gas generated is hydrogen, the velocity is higher. Thus, energetic materials can shock initiate a secondary explosive and can be used as the main energetic material in detonators. Such a detonator has comparatively non-toxic reaction products as compared to traditional detonators.

v. Primers. Although energetic materials are more insensitive to initiation than standard primer formulations, they can be electrically or percussively initiated with additives to make them more amenable to those initiation techniques. Unlike traditional primer materials, the reaction products of energetic materials have very low toxicity. The release of high speed hydrogen gas has the potential to initiate a propellant bed or pyrotechnic mix more rapidly than current primer materials.

As has been described, the present invention provides an improved method for forming energetic material composites.

While the invention has been particularly shown and described with reference to a preferred embodiment, it will be understood by those skilled in the art that various changes in form and detail may be made therein without departing from the spirit and scope of the invention.

What is claimed is:

1. A method for making an energetic material composite, said method comprising:

dissolving a hydrate in a solvent to form a solution;

dispersing fuel particles in said solution; and removing solvent from said solution to form an energetic material composite.

2. The method of claim 1, wherein said solvent is water.

3. The method of claim 1, wherein said removing includes heating.

4. The method of claim 1, wherein said fuel particles have a negative standard reduction potential relative to a standard hydrogen electrode.

5. The method of claim 1, wherein said fuel particles are selected from the group consisting of aluminum, magnesium, titanium, boron, and silicon.

6. The method of claim 1, wherein said fuel particles have a specific surface area greater than 1 $m^2/g$.

7. A method for making an energetic material composite, said method comprising:

dissolving a hydrate in a solvent to form a solution;

dispersing fuel particles in said solution; and removing solvent from said solution to form an energetic material composite, wherein said removing includes vacuum drying.

8. A method for making an energetic material composite, said method comprising:

dissolving a hydrate in a solvent to form a solution;

dispersing fuel particles in said solution; and removing solvent from said solution to form an energetic material composite, wherein said removing includes freeze drying.

* * * * *